United States Patent [19]

Sauder et al.

[11] Patent Number: 4,999,865

[45] Date of Patent: Mar. 19, 1991

[54] FOLDABLE BED ASSEMBLY

[75] Inventors: Myrl D. Sauder, Archbold; Richard A. Roth, Pettisville, both of Ohio

[73] Assignee: Sauder Woodworking Company, Archbold, Ohio

[21] Appl. No.: 447,690

[22] Filed: Dec. 8, 1989

[51] Int. Cl.[5] ..... A47C 17/38

[52] U.S. Cl. ..... 5/149; 5/159.1; 5/155; 5/56

[58] Field of Search ..... 5/2 R, 3, 6, 149, 159 R, 5/155, 150 B, 150 R, 56

[56] References Cited

U.S. PATENT DOCUMENTS

| | | | |
|---|---|---|---|
| 893,364 | 7/1908 | Piaser | 5/149 |
| 915,651 | 3/1909 | Appel . | |
| 1,120,349 | 12/1914 | Weinmann | 5/18 R |
| 1,158,240 | 10/1915 | Kroehler . | |
| 1,216,704 | 2/1917 | Kroehler . | |
| 1,398,727 | 11/1921 | Kozlosky . | |
| 1,757,068 | 5/1930 | Wikman et al. . | |
| 1,821,158 | 8/1932 | Daigle | 5/149 |
| 1,990,959 | 2/1935 | Saperstein . | |
| 2,143,355 | 1/1939 | Martin . | |
| 2,200,052 | 5/1940 | Bowersox . | |
| 2,313,847 | 3/1943 | Thomas . | |
| 2,392,688 | 1/1946 | Nagele . | |
| 2,544,762 | 3/1951 | Lochridge . | |
| 2,568,366 | 9/1951 | Rosen . | |
| 2,605,480 | 8/1952 | Miesner | 5/6 |
| 2,642,584 | 6/1953 | Petersen et al. . | |
| 2,672,624 | 3/1954 | Giuseffi . | |
| 2,751,607 | 6/1956 | Thomas | 5/149 |
| 2,788,528 | 4/1957 | Hansen . | |
| 2,999,250 | 9/1961 | Rea . | |
| 3,069,698 | 12/1962 | Miller . | |
| 3,077,612 | 2/1963 | Sevcik | 5/6 |
| 3,283,341 | 3/1966 | Cerchi . | |
| 3,292,188 | 12/1966 | Gerth . | |
| 3,571,827 | 3/1971 | Rogers | 5/149 |
| 3,585,658 | 6/1971 | Spitz . | |
| 3,852,837 | 12/1974 | Eakins . | |
| 3,863,281 | 2/1975 | Tosic . | |
| 3,900,905 | 8/1975 | Johnson et al. | 5/2 R |
| 3,906,558 | 9/1985 | Alembik | 5/29 |
| 3,934,281 | 1/1976 | Brindisi . | |
| 3,965,498 | 6/1976 | Boni . | |
| 3,972,079 | 8/1976 | Shellow et al. | 5/18 R |
| 3,973,800 | 8/1976 | Kogan | 29/440 |
| 4,200,941 | 5/1980 | Gill et al. . | |
| 4,204,287 | 5/1980 | Lame et al. | 5/18 R |
| 4,292,697 | 10/1981 | Alembik | 5/18 R |
| 4,301,559 | 11/1981 | Geenberghe . | |
| 4,399,571 | 8/1983 | Joyce . | |
| 4,481,684 | 11/1984 | Hauck | 5/18 R |
| 4,631,764 | 12/1986 | Moskowitz | 5/150 B |

FOREIGN PATENT DOCUMENTS

| | | | |
|---|---|---|---|
| 12430 | 4/1881 | Canada . | |
| 39117 | 6/1892 | Canada . | |
| 358100 | 5/1936 | Canada . | |
| 586526 | 11/1959 | Canada . | |
| 701525 | 1/1965 | Canada . | |
| 764301 | 3/1934 | France | 5/149 |
| 59143 | 4/1949 | France | 5/149 |
| 54101 | 7/1934 | Norway | 5/150 B |
| 20465 | of 1898 | United Kingdom | 5/149 |
| 260695 | 8/1925 | United Kingdom . | |

OTHER PUBLICATIONS

Page from a *Yield House* Catalog (undated).

*Primary Examiner*—Gary L. Smith
*Assistant Examiner*—F. Saether
*Attorney, Agent, or Firm*—Emch, Schaffer, Schaub & Porcello Co.

[57] ABSTRACT

A foldable bed assembly is disclosed. A foldable bed frame having a series of foldable sections is positioned within a cabinet for storage and is moved through a wall opening to a horizontal operating position. Links connect the bed frame to the cabinet. Elastic bands slow the movement of respective pairs of foldable sections when moved between the stored position and the operating position.

8 Claims, 5 Drawing Sheets

FOLDABLE BED ASSEMBLY

BACKGROUND OF THE INVENTION

The present invention relates to a bed assembly and more particularly to a bed assembly in which a bed is stored in a piece of decorative furniture, for example, in a cabinet.

Bed assemblies of the class in which the present invention falls are well known in the art. For persons having limited space in their homes or apartments or for persons who desire beds for visitors, a collapsible bed which is stored inside of a piece of furniture is most desirable.

Many prior art temporary beds, which are stored in a cabinet or wall, often were extremely bulky or extremely uncomfortable.

The primary object of the present invention is to provide a piece of furniture having a collapsible bed which is easy to operate and also provides a confortable support for the user.

SUMMARY OF THE INVENTION

The present invention relates to a bed assembly which is stored in a piece of furniture, such as a cabinet. The bed assembly when in an operable position is comfortable and is also readily movable between the operable position to a stored position.

The bed assembly, according to the present invention, comprises a cabinet having a door in a front wall. The cabinet defines a central opening. The bed is movable between a horizontal operating position extending outwardly from the cabinet and a stored positioned within the central opening.

The bed assembly includes a plurality of foldable sections which are movably mounted between the horizontal operating position extending outwardly from the cabinet and the stored position, wherein the collapsed bed is positioned within the central opening of the cabinet.

The bed assembly includes a link mechanism which is attached to each of the side walls of the cabinet or other piece of furniture. The link mechanism is also attached to the first one of the plurality of the foldable sections. Each of the link mechanisms includes a first extended link having first and second ends. The first end of the first link is pivotally mounted to one of the side walls of the cabinet or other piece of furniture, above the horizontal operating position of the bed. An intermediate point on the first link is pivotally attached to the first one of the plurality of foldable bed sections. The second end of the first link is pivotally attached to a leg link. The leg link is attached to a foldable leg assembly mounted on the first foldable section.

A second link is provided in the link mechanism and has a first end pivotally mounted to the side wall below the horizontal operating position of the bed. The second end of the second link is pivotally mounted to the first one of the foldable sections in a spaced relationship from the pivotal mounting of the first link.

In a preferred embodiment, the foldable sections include parallel opposed side rails and at least two cross supports extend between the side rails. Each of the cross supports have a central portion positioned below the level of the opposed side rails. A bed spring is mounted on the opposed side rails and is positioned above the central section of the cross supports. A pair of foldable leg assemblies are provided on the first and last foldable sections.

The bed assembly, according to the present invention, also includes hinge assemblies between the foldable sections which are easy to operate and also tend to protect a user of the bed assembly during the opening and the closing of the bed assembly from the operating position to the stored position.

DESCRIPTION OF THE PREFERRED EMBODIMENTS

Figure 1:
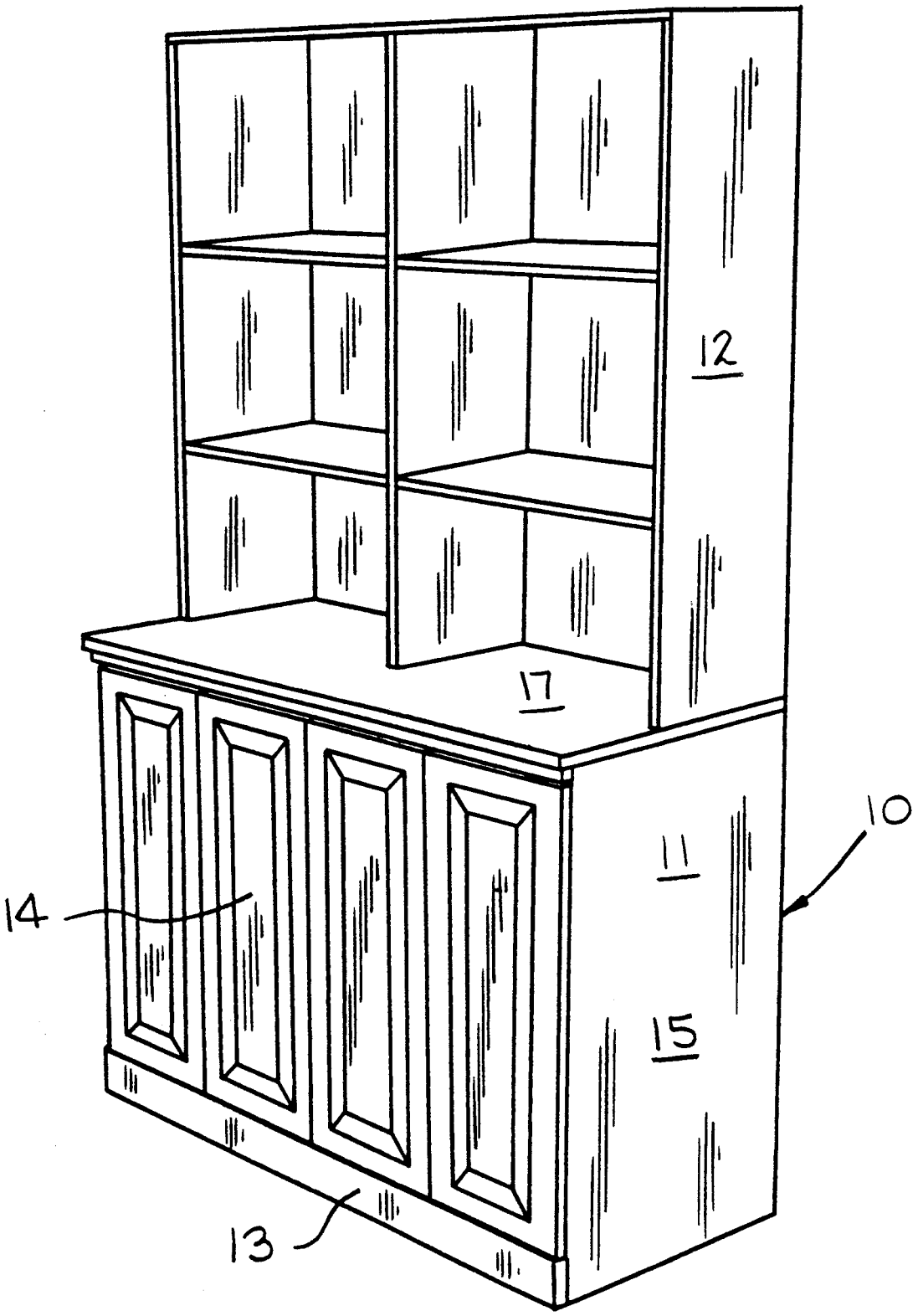
FIG. 1 is a perspective view of a bed assembly, according to the present invention, shown in a stored position.

A bed assembly, according to the present invention, is generally indicated in FIG. 1 by the reference number 10. The bed assembly 10 includes a cabinet 11 and a bookcase 12 positioned above the cabinet 11. The cabinet 11 includes a front wall 13 having a pair of bifold doors 14. The cabinet 11 also includes opposed side walls 15 and 16, a top 17, a back 18 and a bottom support 19.

Figure 3:
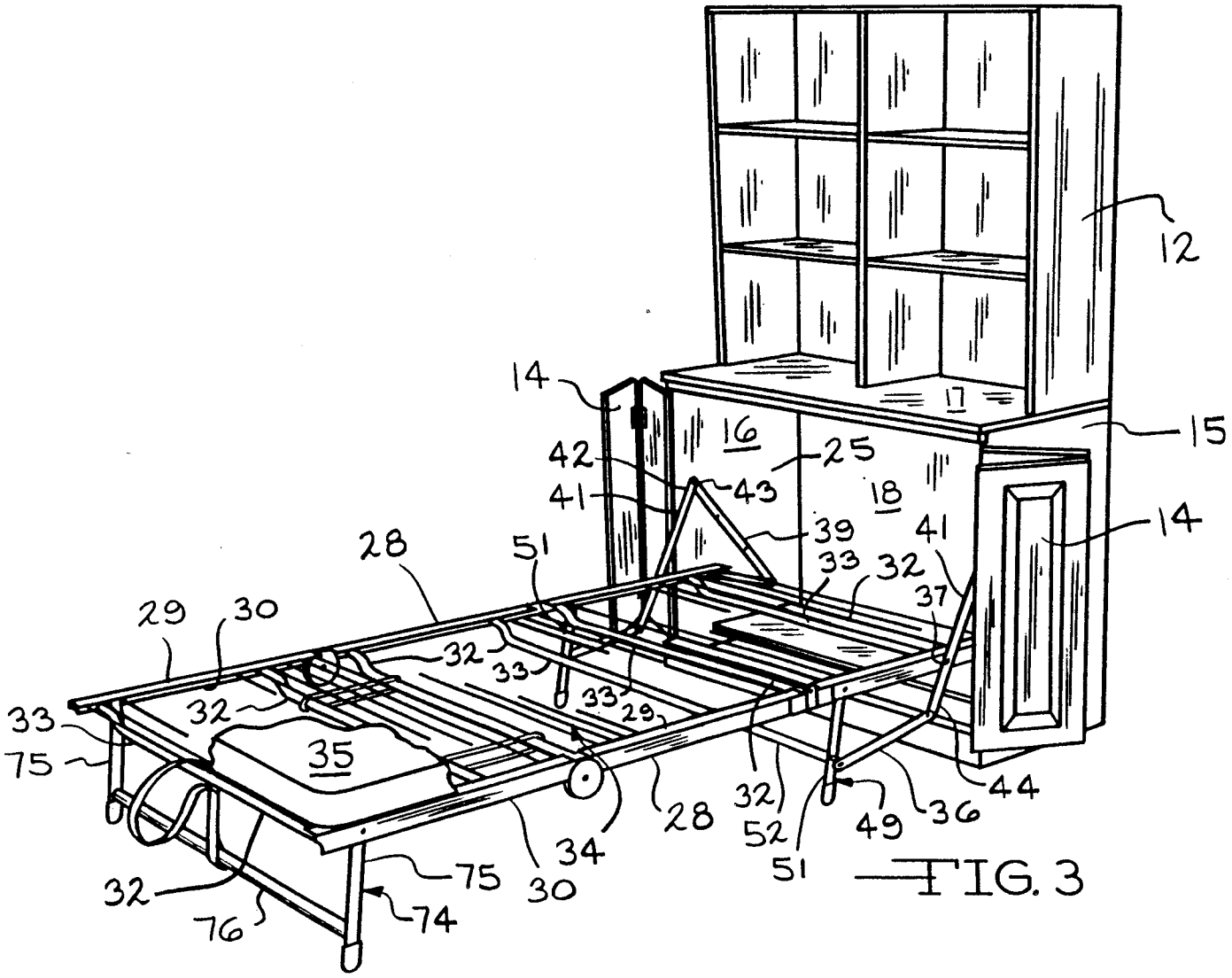
FIG. 3 is a perspective view of the bed assembly, according to the present invention, shown in the horizontal operating position and showing a fragmentary portion of a mattress.

The bed assembly 10 includes a plurality of foldable sections 22, 23 and 24 movable between a horizontal operating position, illustrated in FIG. 3, and a collaped, stored position, illustrated in FIG. 1. The cabinet 11 includes a central opening 25 and the foldable sections 22, 23 and 24 are positioned within the central opening 25 when the bed assembly 10 is in its stored position.

Each of the foldable sections 22, 23 and 24 includes opposed side rails 28 which are constructed from structural angles having horizontal flanges 29 and vertical flanges 30. At least two cross bars 32 extend between the side rails 28 of each of the foldable sections 22, 23 and 24. Each of the cross bars or cross supports 32 is generally "U" shaped and has a central portion 33 positioned below the level of the opposed side rails 28 when the bed assembly 10 is in the horizontal operating position shown in FIG. 3. The level of the central portion 33 ensures that a user will normally not feel the support 32.

Bed springs 34 extend between the opposed side rails 28 and are positioned above the cross supports 32. A mattress 35 is preferably positioned over the bed springs 34.

Figure 8:
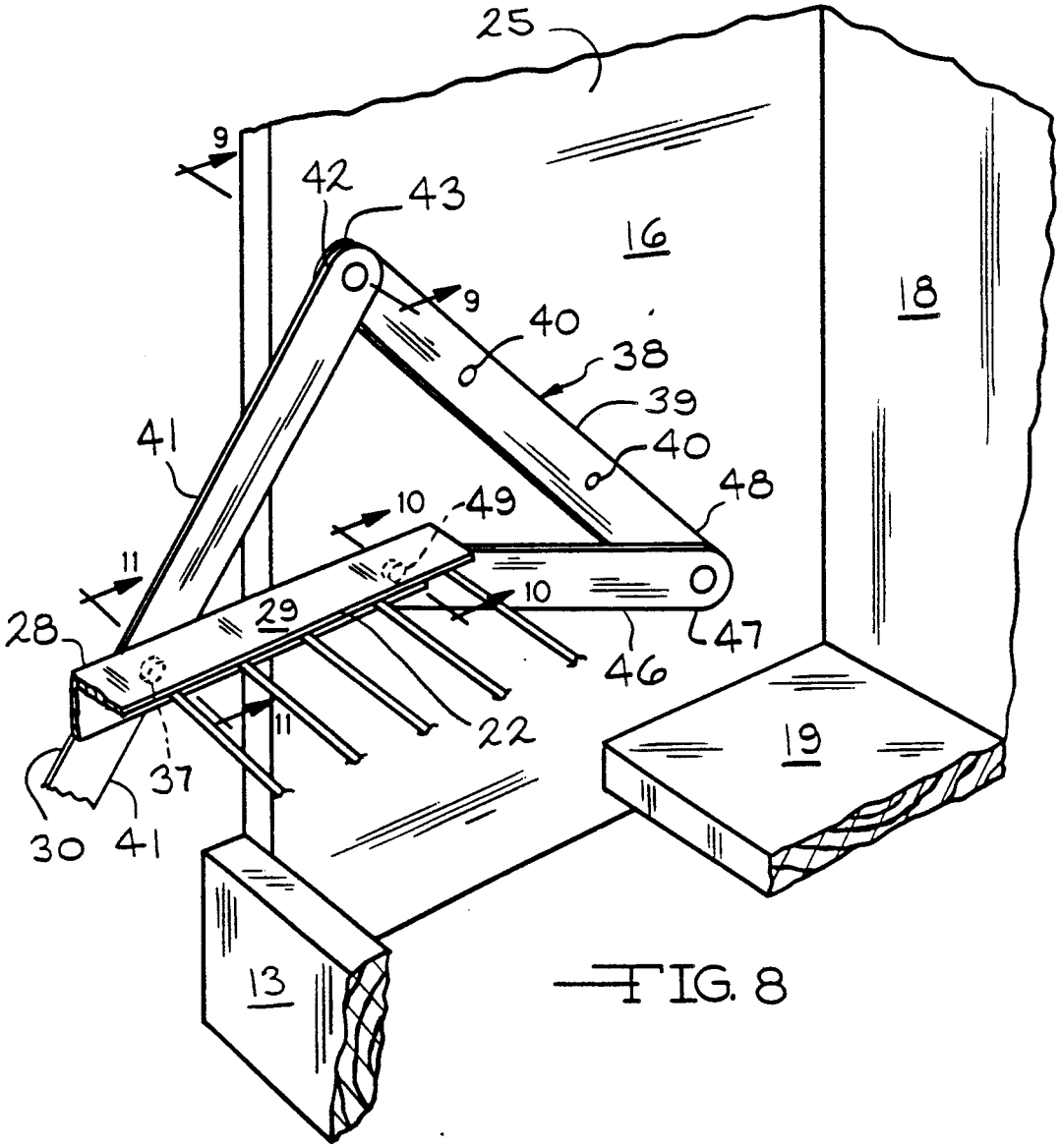
FIG. 8 is a fragmentary perspective view showing the link assembly, according to the present invention.
Figure 9:
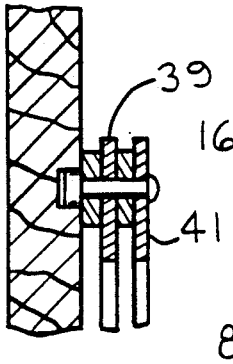
FIG. 9 is a cross sectional view taken along the lines 9—9 of FIG. 8.
Figure 10:
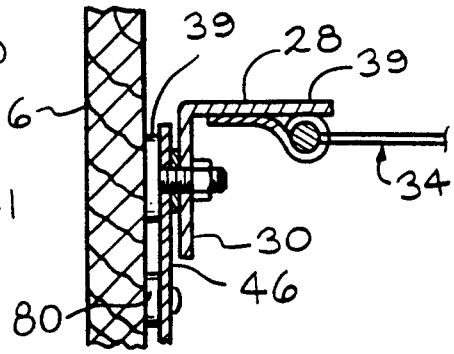
FIG. 10 is a cross sectional view taken along the lines 10—10 of FIG. 8.
Figure 11:
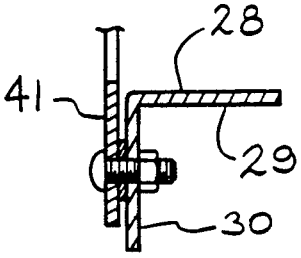
FIG. 11 is a cross sectional view taken along the lines 11—11 of FIG. 8.

One important feature of the present invention are link assemblies, generally indicated by the reference number 38, which are mounted on the side walls 15 and 16 of the cabinet 11 and which are pivotally connected to the first foldable section 22. Referring to FIG. 8, the link assembly 38, in the present embodiment, includes a base member 39 which is attached to the side walls 15 and 16 of the cabinet 11 by fasteners 40. The base member 39 is positioned at an approximate 45° angle with respect to the horizontal. A first link 41, having an extended length is pivotally mounted to one of the side walls 15, 16 by a first end 42 and to an upper end 43 of the base member 39. An intermediate point 37 of the first link 41 is pivotally mounted to the side rail 28 of the first foldable section 22. The distance between the first end 42 and the intermediate point 37 is approximately equal to the length of the base member 39. The second end 44 of the first link 41 is pivotally connected to a first end of a leg link 36, which in turn has its second end pivotally connected to a leg assembly 49.

The leg assembly 49 is foldable and pivotally connected to the first foldable section 22. The leg assembly 49 includes legs 51 and a cross member 52 extending between the legs 51. The cross member 52, in the present embodiment, is a rod which extends through and is welded to the opposed legs 51. The outer ends of the cross member 52 are pivotally connected to the second ends of the leg links 36.

A second link 46 having a length approximately the same as the base member 39 has a first end 47 pivotally mounted to one of the side walls 15, 16 and to a lower end 48 of the base member 39. A second end 49 of the second link 46 is pivotally attached to the first foldable section 22 in a spaced relationship with the intermediate point 37 of the first link 41. The distance between this spaced connection being approximately 5 and ½ inches in the present embodiment.

In the present embodiment, nylon guide spacers 80 are mounted on the second links 46 adjacent the cabinet side walls 15 and 16. The guide spacers 80 guide the link assemblies 38 as they are opened and closed during movement of the sections 22, 23 and 24.

The pivotal connection of the first end 42 is above the horizontal operating position of the bed assembly 10, while the pivotal connection of the first end 47 of the second link 46 is below the horizontal operating position of the bed assembly 10.

A second leg assembly 74 is pivotally mounted at the distal end of the third foldable section 24. The second leg assembly 74 includes legs 75 which are pivotally connected to the side rails 28 and a cross member 76 connected between the opposed legs 75.

While the present bed assembly 10 includes the first foldable section 22, the second foldable section 23 and the third foldable section 24, other embodiments (not shown) may include either fewer or more foldable sections. In the present embodiment, the first foldable section 22 is pivotally connected to the second foldable section 23 by a pair of opposed first hinge assemblies 50 and the third foldable section 24 is pivotally connected to the second foldable section 23 by a pair of opposed hinge assemblies 53. The hinge assemblies 50 and 53 are designed to lessen the chances of operator injury during the folding of the bed assembly 10 between the operating position and the stored position.

Each of the first hinge assemblies 50 positioned between the first foldable section 22 and the second foldable section 23 include a pair of overlying hinge members 55 and 56. The hinge member 55 includes a hinge leg 57 mounted on the vertical flange 30 of the second foldable section 23 and a raised generally semicircular body member 58. Similarly, the hinge member 56 includes a hinge leg 59 mounted on the first foldable section 22 and a semicircular body member 60 which overlies the semicircular body member 58. A recess 62 is defined by the vertical flanges 30 of the abutting foldable sections 22 and 23 and tends to prevent injury to the operators. Similarly, an opening 63 is defined by the abutting top horizontal flanges 29 of the abutting first and second foldable sections 22 and 23.

Figure 4:
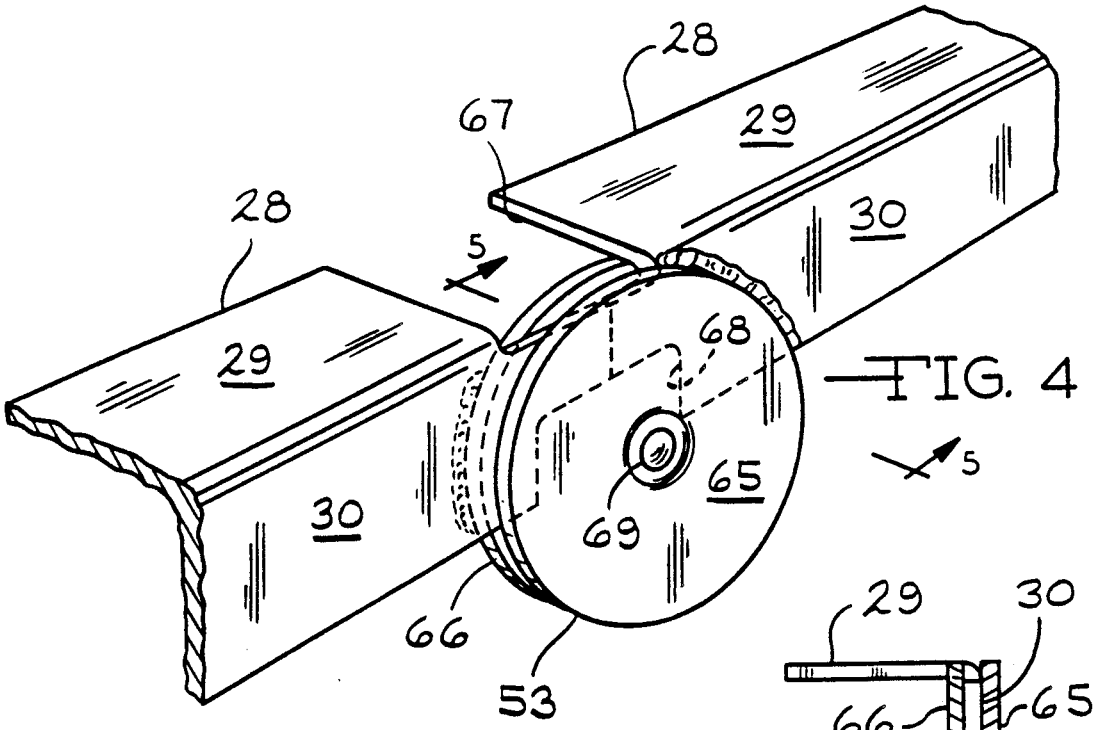
FIG. 4 is a fragmentary elevational view, shown on an enlarged scale, of the hinge assembly located between the second and third foldable sections of the bed assembly, according to the present invention.
Figure 5:
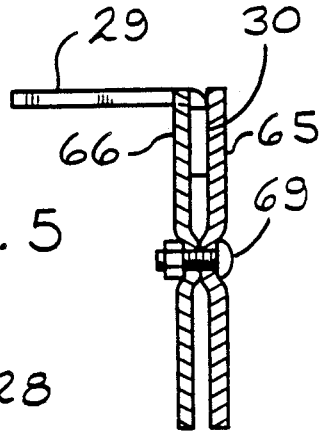
FIG. 5 is a cross sectional view taken along the lines 5—5 of FIG. 4.
Figure 6:
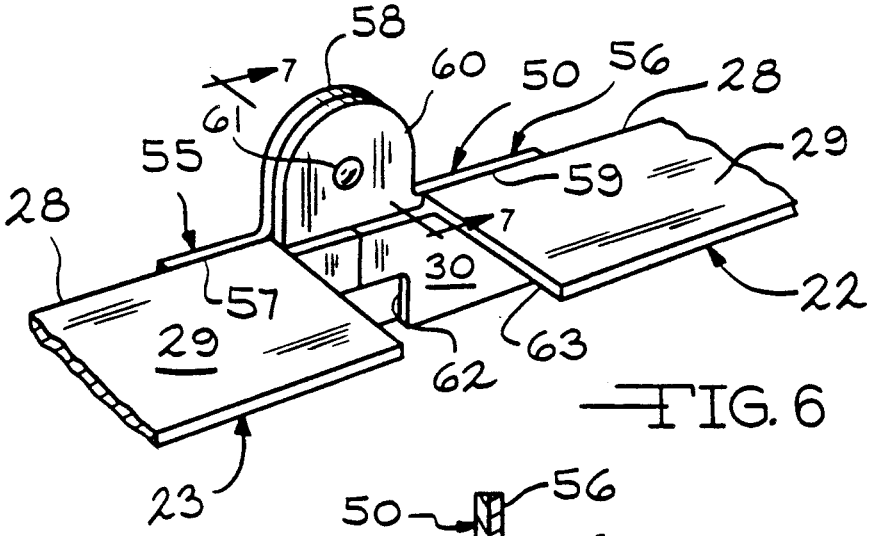
FIG. 6 is a fragmentary elevational view, shown on an enlarged scale, of a hinge assembly located between the first and second foldable sections of the bed assembly, according to the present invention.
Figure 7:
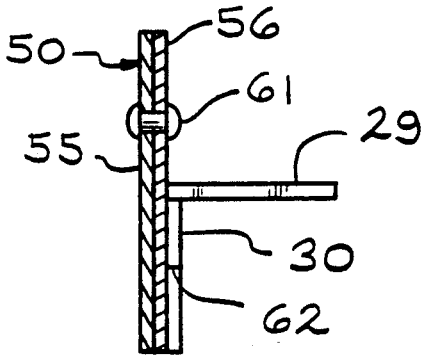
FIG. 7 is a cross sectional view taken along the lines 7—7 of FIG. 6.

Referring to FIGS. 4 and 5, the second hinge assemblies 53, between the second foldable sections 23 and third foldable sections 34 are shown. The opposed second hinge assemblies 53 include a pair of circular body members 65 and 66 positioned on opposite sides of the vertical flanges 30. The body member 65 is welded or otherwise attached to the vertical flange 30 of the side rail 28 of the second foldable section 23, while the body member 66 is welded or otherwise attached to the vertical flange 30 of the side rail 28 of the third foldable section 24. A pivot pin 61 pivotally connects the members 65 and 66 to one another, as shown in FIG. 6. The abutting horizontal flanges 29 define an upper opening 67 while the abutting vertical flanges 30 define a lower recess 68.

Referring to FIGS. 4 and 5, the circular body members 65 and 66 are pivotally mounted to one another by a pivot pin 69 which extends through the lower recess 68.

Figure 2:
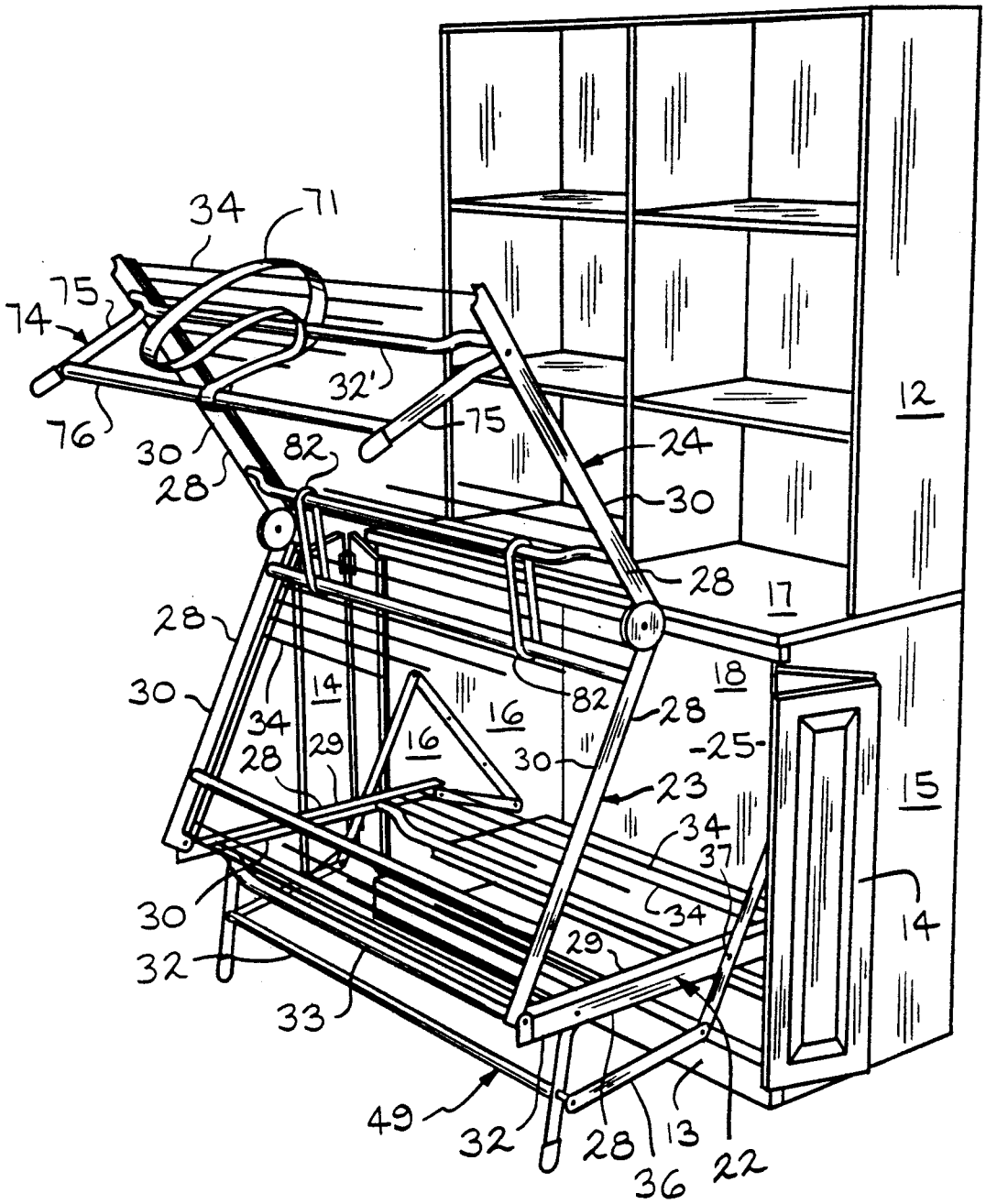
FIG. 2 is a perspective view of a bed assembly, according to the present invention, with the cabinet doors open and the foldable sections being moved between the stored position and the open position.

Referring to FIG. 2, a strap assembly 71 has a small loop which is attached to the cross member 76 of the second leg assembly 74. The strap assembly 71 has an upper larger loop which extends around the cross bar 32' of the third foldable section 24 and is also attached around a portion of the bed springs 34. The strap assembly 71 may be grasped by the operator for movement of the foldable sections 22, 23 and 24 between the stored position and the operating position.

The first leg assembly 49 is pivotally mounted on the first foldable section 22 for movement between an active position when the bed assembly is in its horizontal operating position and an inactive position when the foldable sections 22, 23 and 24 are in the stored position. The second leg assembly 74 is pivotally mounted on the third foldable section 24 at its distal end for movement between the operating position and the stored position.

After the operator opens the bifold doors 14 of the cabinet 11, the strap assembly 71 is grasped and pulled. The positioning of the strap assembly 71 automatically moves the second leg assembly 74 into its operating position as the sections 22, 23 and 24 are unfolded, as shown in FIG. 2. Similarly, the extended first links 41 and the leg links 36 automatically move the first leg assembly 49 to its active position.

A plurality of elastic bands 82 extend around the central portions 33 of the adjacent cross bars 32 located adjacent the second hinge assemblies 53, the elastic bands 82 slow the speed of opening as the sections 22, 23 and 24 are moved to the operating position shown in FIG. 3.

After opening, the mattress 35 is removed from the back of the cabinet 11 and positioned on the springs 34 as indicated in FIG. 3.

Many revisions may be made to the preferred embodiment, shown in the drawings and described above, without departing from the scope of the following claims.

We claim:

1. A bed assembly comprising a cabinet having at least one door in a front wall, side walls, and defining a central opening, a bed frame having a plurality of foldable sections including a first foldable section movably mounted between a horizontal operating position extending outwardly from said cabinet and a stored position within said central opening, a link assembly attached to each of said side walls and to said first foldable section, each of said link assemblies including a first link having first and second ends, said first link first end being pivotally mounted to one of said side walls above said horizontal operating position, said first link being pivotally mounted to said first foldable section, a second link having first and second ends, said second link first end being pivotally mounted to one of said side walls below said horizontal operating position, said second link second end being pivotally mounted to said first foldable section and spaced from the pivotal mounting of said first link, a leg assembly pivotally connected to said first foldable section, a leg link attached to each side of said leg assembly, said second end of said first link being pivotally connected to said leg link, wherein said leg assembly is moved to an active position when said bed assembly is moved from the stored position to the horizontal operating position, each of said link assemblies including a base member having upper and lower ends, said base member being fixed to one of said side walls, said base member upper end being connected to said first link first end and said base member lower end being pivotally connected to said second link first end, said bed frame of each of said plurality of foldable sections including parallel opposed side rails and at least two cross supports extending between said opposed side rails, each of said cross supports having a central section positioned below the level of said opposed side rails when said bed assembly is in such horizontal operating position, and elastic bands between adjacent ones of said cross supports for slowing the movement of respective pairs of said plurality of foldable sections as the bed assembly is moved between its stored position and its horizontal operating position.

2. A bed assembly, according to claim 1, including bed springs positioned over said cross supports and extending between said opposed side rails.

3. A bed assembly, according to claim 1, wherein said plurality of foldable sections comprises three sections, said first foldable section, pivotally connected to said cabinet by said link assemblies, a second foldable section pivotally connected to said first foldable section by a first pair of opposed hinge assemblies and a third foldable section pivotally connected to said second foldable section by a second pair of opposed hinge assemblies.

4. A bed assembly, according to claim 3, including a strap assembly attached to said third foldable section for grasping by an operator for movement of said foldable sections between such stored position and such operating position.

5. A bed assembly, according to claim 1, including a mattress positioned over said bed springs when said foldable sections are in such horizontal operating position.

6. A bed assembly, according to claim 3, wherein said side rails comprise angle members having a horizontal flange and a vertical flange, said horizontal flange defining openings adjacent the pivotal connection between said first and second foldable sections, each of said first pair of opposed hinge assemblies including a pair of overlying hinge members having a hinge leg mounted to said vetical flange of one of said first and second foldable sections and a generally semicircular body member extending above said horizontal flanges adjacent such openings, said semicircular body members overlying one another and being pivotally connected to one another.

7. A bed assembly, according to claim 3, wherein said side rails comprise angle members having a horizontal flange and a vertical flange, said horizontal flanges defining openings adjacent the pivotal connection between said second and third foldable sections, said vertical flanges of said second and third foldable sections abutting one another and defining a lower recess adjacent their lower edges, each of said second pair of opposed hinge assemblies including a pair of circular body members positioned on opposite sides of said vertical flanges, each of said circular body members being connected to a respective one of said second and third foldable sections, said circular body members being pivotally connected to one another by a pivot pin which extends through such lower recess.

8. A bed assembly comprising a cabinet having at least one door in a front wall, side walls, and defining a central opening, a bed frame having a plurality of foldable sections including a first foldable section movably mounted between a horizontal operating position extending outwardly from said cabinet and a stored position within said central opening, a link assembly attached to each of said side walls and to said first foldable section, each of said link assemblies including a first link having first and second ends, said first link first end being pivotally mounted to one of said side walls above said horizontal operating position, said first link being pivotally mounted to said first foldable section, a second link having first and second ends, said second link first end being pivotally mounted to one of said side walls below said horizontal operating position, said second link second end being pivotally mounted to said first foldable section and spaced from the pivotal mounting of said first link, a leg assembly pivotally connected to said first foldable section, a leg link attached to each side of said leg assembly, said second end of said first link being pivotally connected to said leg link, wherein said leg assembly is moved to an active position when said bed assembly is moved from the stored position to the horizontal operating position, each of said link assemblies including a base member having upper and lower ends, said base member being fixed to one of said side walls, said base member upper end being pivotally connected to said first link first end and said base member lower end being pivotally connected to said second link first end, said bed frame of each of said plurality of foldable sections including parallel opposed side rails and at least two cross supports extending between said opposed side rails, each of said cross supports having a central section positioned below the level of said opposed side rails when said bed assembly is in such horizontal operating position, and means between adjacent ones of said cross supports for slowing the movement of respective pairs of said plurality of foldable sections as the bed assembly is moved between its stored position and its horizontal operating position.

* * * * *